US011821380B2

(12) United States Patent
Lin et al.

(10) Patent No.: US 11,821,380 B2
(45) Date of Patent: Nov. 21, 2023

(54) METHOD FOR CONTROLLING FUEL INJECTION OF ENGINE AND ENGINE FUEL INJECTION CONTROL APPARATUS APPLYING THE METHOD

(71) Applicant: GUANGZHOU AUTOMOBILE GROUP CO., LTD., Guangzhou (CN)

(72) Inventors: Sicong Lin, Guangzhou (CN); Bo Qin, Guangzhou (CN); Hao Feng, Guangzhou (CN); Yang Liu, Guangzhou (CN)

(73) Assignee: GUANGZHOU AUTOMOBILE GROUP CO., LTD., Guangzhou (CN)

( * ) Notice: Subject to any disclaimer, the term of this patent is extended or adjusted under 35 U.S.C. 154(b) by 1 day.

(21) Appl. No.: 17/824,024

(22) Filed: May 25, 2022

(65) Prior Publication Data

US 2022/0316413 A1 Oct. 6, 2022

Related U.S. Application Data

(63) Continuation-in-part of application No. PCT/CN2021/099248, filed on Jun. 9, 2021.

(30) Foreign Application Priority Data

Aug. 6, 2020 (CN) ..... 202010784359.8

(51) Int. Cl.
*F02D 41/30* (2006.01)
*F02D 41/04* (2006.01)

(52) U.S. Cl.
CPC .... *F02D 41/047* (2013.01); *F02D 2200/0414* (2013.01); *F02D 2200/0618* (2013.01); *F02D 2200/101* (2013.01); *F02D 2200/1002* (2013.01)

(58) Field of Classification Search
CPC .... F02D 41/047; F02D 41/1402; F02D 41/38; F02D 2200/0414; F02D 2200/0618; F02D 2200/1002; F02D 2200/101
USPC ..... 123/1 A, 198 A, 299, 300
See application file for complete search history.

(56) References Cited

U.S. PATENT DOCUMENTS 5,797,367 A 8/1998 Iida et al.
2016/0305313 A1 10/2016 Kumar et al.

*Primary Examiner* — Hai H Huynh
(74) *Attorney, Agent, or Firm* — ScienBiziP, P.C.

(57) ABSTRACT

A method of controlling fuel injection to an internal combustion engine to reduce cylinder wall wetting, smokiness, and unclean combustion, on a cumulative basis, applies a self-adaptive control on a gasoline injection initial angle. Gasoline injection initial or original angle is known, being preset, and a self-adaptive controlling volume is added. The self-adaptive controlling volume is the addition of a first self-adaptive controlling volume and a second self-adaptive controlling volume to the original angle. The first self-adaptive controlling volume relates to predicted load and an engine coolant temperature. The second self-adaptive controlling volume is based on the rotating speed of the engine. Cylinder wall wetting is reduced or avoided, smoke is reduced, and cleaner combustion is achieved. An engine fuel injection control apparatus applying the method is also provided.

18 Claims, 3 Drawing Sheets

METHOD FOR CONTROLLING FUEL INJECTION OF ENGINE AND ENGINE FUEL INJECTION CONTROL APPARATUS APPLYING THE METHOD

The present disclosure claims the priority of the Chinese invention patent application submitted to the State Intellectual Property Office of China on Aug. 6, 2020, application No. 202010784359.8, and the whole content of which is hereby incorporated by reference.

TECHNICAL FIELD

The subject matter herein generally relates to engine control, particularly to a method for controlling fuel injection of the engine and an engine fuel injection control apparatus applying the method.

BACKGROUND

An electronic fuel injection control system is used in many engines. An electronic control unit (ECU) is a control center and receives parameters from sensors disposed on different positions of the engine. Fuel is injected into the engine under a control program set in the ECU for ensuring a suitable mix of gas and air to be supplied to the engine under different conditions.

The in-cylinder direct-injection engine injects gasoline into the cylinder under an extreme pressure. If there is an initial angular deviation when injecting and the temperature in the cylinder is low, the gasoline may wet the wall of the cylinder. Gasoline on the wet wall is harder to vaporize than gasoline in form of a cloud or fog in the air. While injecting gasoline, the electronic fuel injection control system detects a condition of the engine for searching an initial injecting angle from a relationship table between the conditions and the initial injecting angles. When the engine changes from a light load into a heavy load, the temperature between the piston and the cylinder sleeve increases, but gradually. Before the temperature reaches a required value corresponding to the heavy load, the gasoline at the searched initial injecting angle may be injected to the wall of the cylinder sleeve or to the piston. Thus, smoke may be generated while the gasoline being burned, resulting energy lost, and incomplete combustion.

Thus, there is room for improvement in the art.

BRIEF DESCRIPTION OF THE DRAWINGS

Implementations of the present disclosure will now be described, by way of example only, with reference to the attached figures.

DETAILED DESCRIPTION

Figure 1:
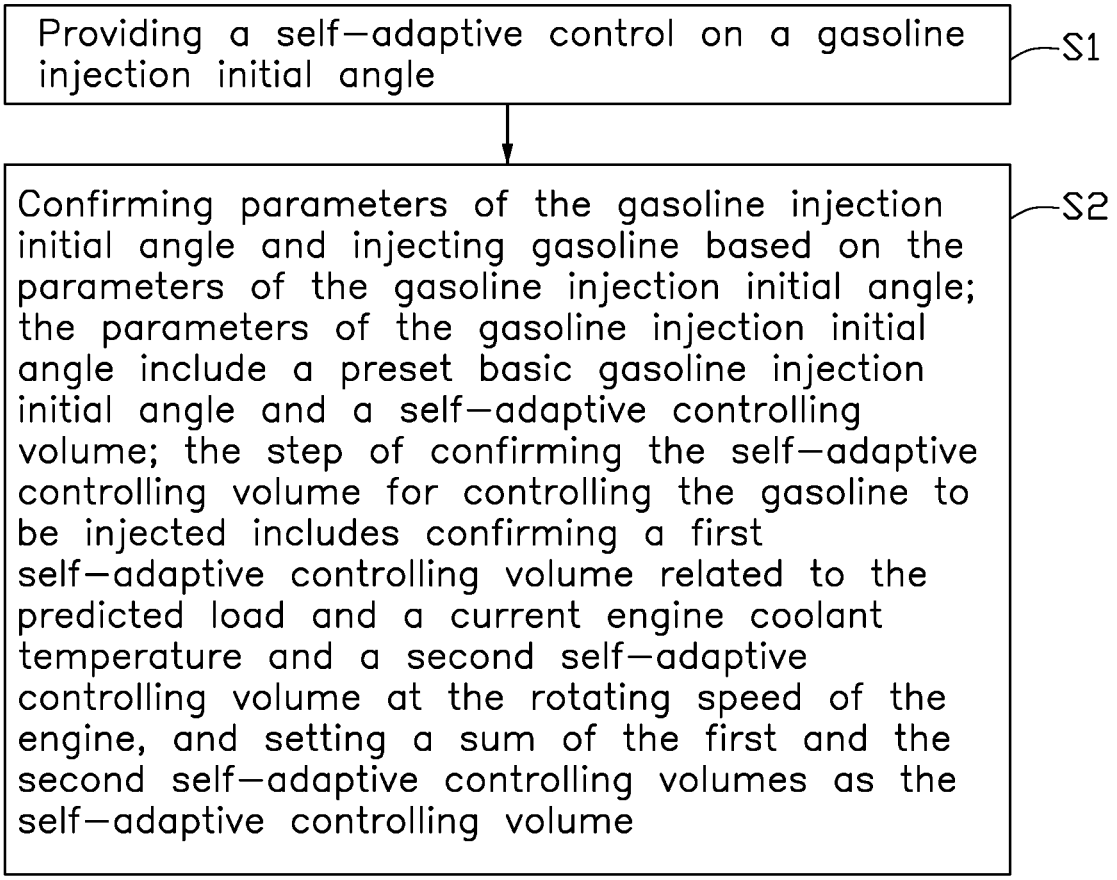
FIG. 1 is a flowchart illustrating a first embodiment of a method of controlling fuel injection of an engine according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

FIG. 1 shows a first embodiment of a method of controlling fuel injection of an engine. The method includes the following steps, these steps may be re-ordered:

In block S1, a self-adaptive control on a gasoline injection initial angle is provided.

The gasoline injection initial angle is an angle of a fuel injector for injecting fuel, and also can be an angle formed by the fuel injected from the fuel injector under a pressure. The gasoline injection initial angle relates to a combustion efficiency of the engine, which further relates to carbon emissions.

In one embodiment, the block S1 further comprises

A condition of the engine is obtained and monitored when the engine is activated.

When the condition of the engine matches with a specified condition, the self-adaptive control is provided.

For example, when an electronic control unit (ECU) detects that the engine is started, the condition of the engine is obtained through sensors on the engine in different positions on the engine. When the condition of the engine matches with the specified condition, the self-adaptive control can be applied, which is a self-adaptive controlling mode. Under the self-adaptive controlling mode, the gasoline injection initial angle is adjusted through several steps.

The condition of the engine includes time duration of the running engine, a predicted load of the engine, a power-up speed of the engine, an intake air temperature, and a state of the engine. The specified condition includes the time duration of the running engine being larger than a first specified value, the predicted load of the engine being larger than a second specified value, the power-up speed of the engine being larger than a third specified value, the intake air temperature being greater than a fourth specified value, and the engine in a running (i.e. started state) state.

The running state of the engine is related to other parameters, such as an accelerator, not being limited thereto. The load of the engine is a ratio between a power of the engine and a maximum power under a same specified rotating speed. The load of the engine is expressed as a percentage, an accelerator magnitude, a throttle percentage, or a vacuum degree. The predicted load is calculated based on the current load and other parameters.

In block S2, parameters of the gasoline injection initial angle are confirmed, and gasoline is injected based on the parameters of the gasoline injection initial angle.

The parameters of the gasoline injection initial angle include a preset basic gasoline injection initial angle and a self-adaptive controlling volume. The step of confirming the self-adaptive controlling volume for controlling the gasoline to be injected includes confirming a first self-adaptive controlling volume related to the predicted load and the current engine coolant temperature and a second self-adaptive controlling volume at the rotating speed of the engine, and setting a sum of the first and the second self-adaptive controlling volumes as the self-adaptive controlling volume.

The preset basic gasoline injection initial angle is an original gasoline injection angle of the engine (or an injection phase). The self-adaptive controlling volume is an adjusted angle based on the basic gasoline injection initial angle. The final gasoline injection initial angle is the preset basic gasoline injection initial angle being added to or subtracted from the self-adaptive controlling volume. The step of confirming the parameters of the gasoline injection initial angle and injecting the gasoline based on the parameters of the gasoline injection initial angle includes a step of confirming the parameters of the gasoline injection initial angle, and a step of injecting the gasoline based on the parameters of the gasoline injection initial angle. In one embodiment, while confirming the parameters of the gasoline injection initial angle, the first self-adaptive controlling volume related to the load and an engine coolant temperature is confirmed based on the predicted load and the engine coolant temperature. The second self-adaptive controlling volume related to the rotating speed is confirmed based on the rotating speed of the engine. The first self-adaptive controlling volume and the second self-adaptive controlling volume are added together as the self-adaptive controlling volume. In one embodiment, the step of confirming the self-adaptive controlling volume can be adjusted based on the injection phase under a condition of instantaneous acceleration.

The self-adaptive controlling volume is a fixed value, therefore only the step of confirming the parameters of the gasoline injection initial angle only the self-adaptive controlling volume needs to be confirmed based on the condition of the engine. The process of injecting the gasoline is controlled based on the preset basic gasoline injection initial angle and the confirmed self-adaptive controlling volume. Therefore, the step of injecting the gasoline based on the parameters of the gasoline injection initial angle can be determined as the step of confirming the self-adaptive controlling volume for controlling the gasoline to be injected.

In one embodiment, the parameters of the gasoline injection initial angle can further include a controlling time duration.

In one embodiment, the parameters of the gasoline injection initial angle include the preset basic gasoline injection initial angle, the self-adaptive controlling volume, and the controlling time duration. The controlling time duration is a maximum time duration of injecting the gasoline based on the gasoline injection initial angle. The time duration of injecting the gasoline can be less than the controlling time duration.

In one embodiment, when the parameters of the gasoline injection initial angle further include a controlling time duration, the step of injecting the gasoline based on the parameters of the gasoline injection initial angle includes:

A first controlling time duration is confirmed based on the predicted load of the engine and the engine coolant temperature.

A second controlling time duration is confirmed based on the rotating speed of the engine.

The controlling time duration is obtained by adding the first controlling time duration and the second controlling time duration. The step of injecting the gasoline based on the parameters of the gasoline injection initial angle further comprises injecting the gasoline at a gasoline injection angle, which is a sum of the self-adaptive controlling volume and the preset basic gasoline injection initial angle, under a limitation of the controlling time duration.

In one embodiment, the parameters of the gasoline injection initial angle include the preset basic gasoline injection initial angle, the self-adaptive controlling volume, and the controlling time duration. Both the self-adaptive controlling volume and the controlling time duration relate to the predicted load of the engine and the current engine coolant temperature. A sum of the self-adaptive controlling volume and the controlling time duration is a final value of the controlling time duration. The controlling time duration is expressed as a number of strokes.

Figure 2:
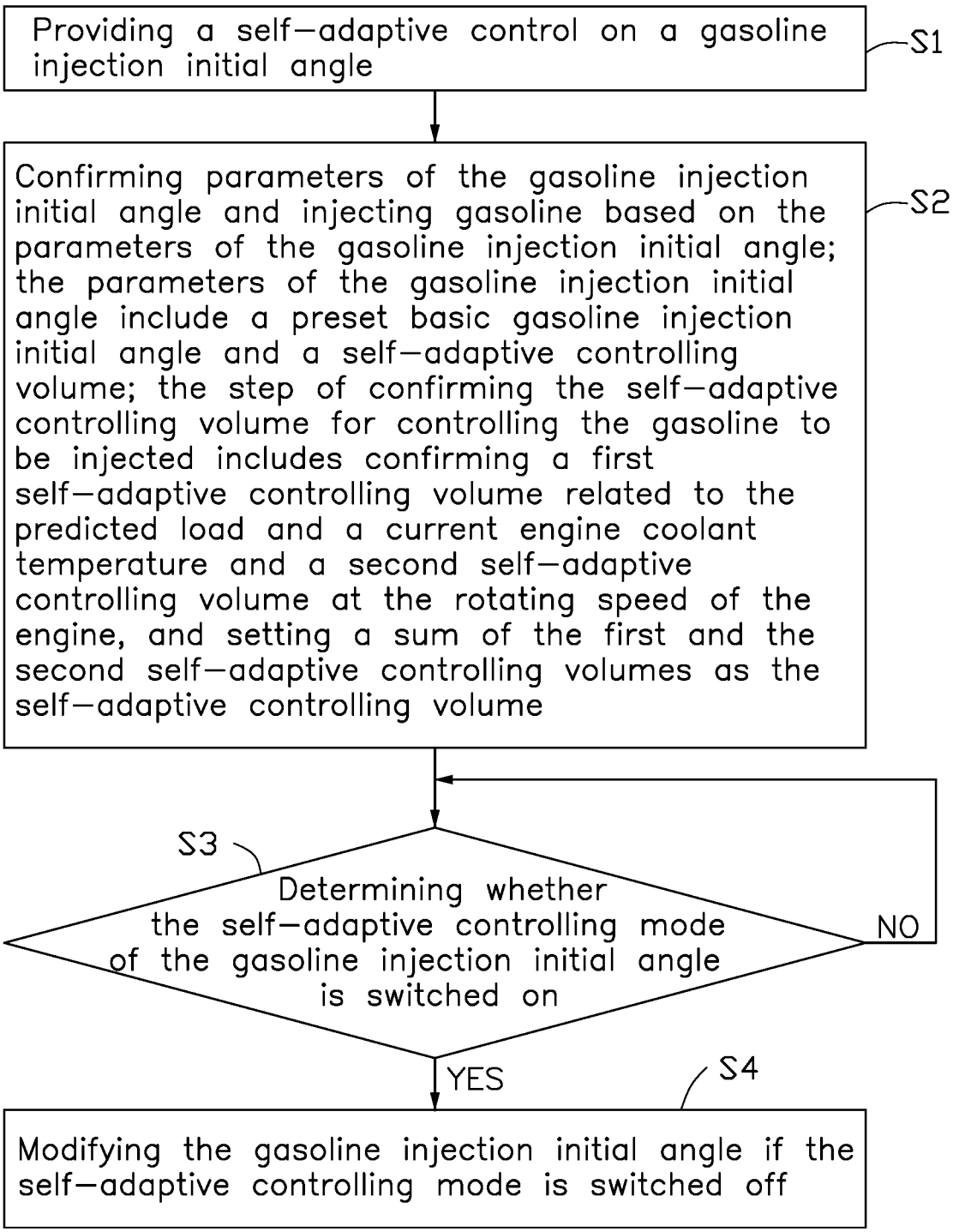
FIG. 2 is a flowchart illustrating a second embodiment of a method of controlling fuel injection in an engine according to the present disclosure.

FIG. 2 shows a second embodiment of a method of controlling fuel injection of an engine. The method includes the following steps after the block S2, these steps may be re-ordered:

In block S3, determining whether the self-adaptive controlling mode of the gasoline injection initial angle is switched on.

The process of switching off the self-adaptive controlling mode of the gasoline injection initial angle controls the gasoline to be again injected based only on the preset gasoline injection initial angle.

The step of determining whether the self-adaptive controlling mode of the gasoline injection initial angle is switched off can comprise:

The predicted load of the engine or an operation time of the self-adaptive control is obtained.

When the predicted load of the engine is less than a preset value or the operation time of the self-adaptive control is greater than or equal to the controlling time duration, the self-adaptive controlling mode of the gasoline injection initial angle is switched off.

The switching off the self-adaptive controlling mode is determined by the predicted load of the engine or the operation time of the self-adaptive control. If one of the predicted load of the engine and the operation time of the self-adaptive control matches with the corresponding condition, the procedure goes to the block S4. When neither the predicted load of the engine nor the operation time of the self-adaptive control matches with the corresponding condition, the gasoline is injected based only on the parameters of the gasoline injection initial angle.

In block S4, after the switching off the self-adaptive controlling mode, the gasoline injection initial angle is modified. The process of modifying the gasoline injection initial angle decreases the self-adaptive controlling volume by a specified gradient value until it is zero.

The self-adaptive controlling volume decreases by the specified gradient value until it is zero. The self-adaptive controlling volume also can be decreased in other manners. For example, there can be a first gradient value and a second gradient value less than the first gradient value. In a second embodiment, there are different gradient values. In a third embodiment, the self-adaptive controlling volume can directly decrease to zero. The decreasing manner under the fixed gradient descent is smoother and more stable.

Figure 3:
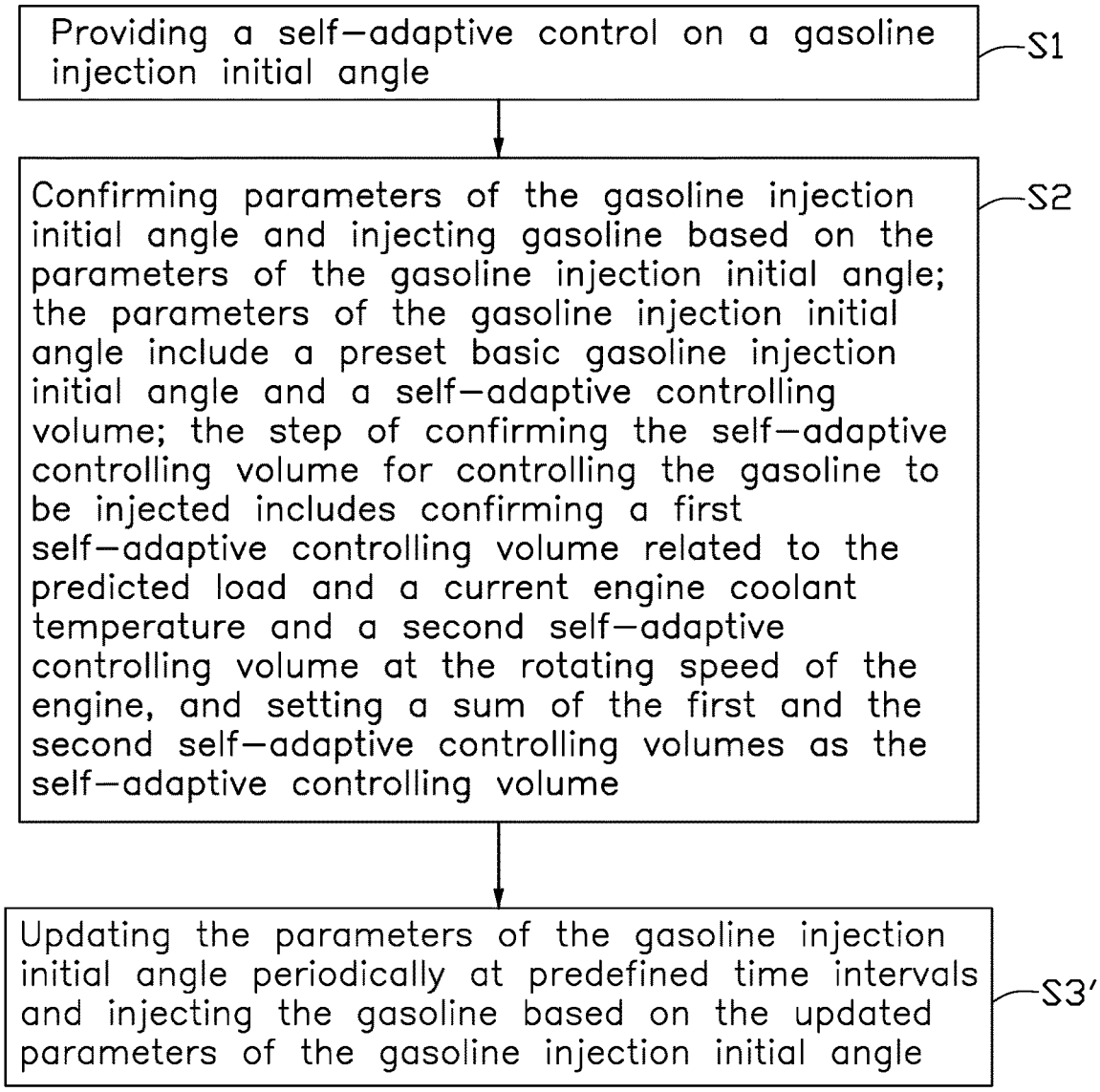
FIG. 3 is a flowchart illustrating a third embodiment of a method of controlling fuel injection in an engine according to the present disclosure.

FIG. 3 shows a third embodiment of the method of controlling fuel injection of an engine. The method includes the following steps, these steps may be re-ordered:

In block S1, a self-adaptive control on a gasoline injection initial angle is applied.

In block S2, parameters of the gasoline injection initial angle are confirmed, and gasoline is injected based on the parameters of the gasoline injection initial angle.

The parameters of the gasoline injection initial angle include a preset basic gasoline injection initial angle and a self-adaptive controlling volume. The step of confirming the self-adaptive controlling volume for controlling the gasoline to be injected includes confirming a first self-adaptive controlling volume related to the predicted load and the current engine coolant temperature and a second self-adaptive controlling volume related to the rotating speed of the engine, and setting a sum of the first and the second self-adaptive controlling volumes as the self-adaptive controlling volume.

In block S3', the parameters of the gasoline injection initial angle are periodically updated at predefined time intervals and the gasoline is injected based on the updated parameters of the gasoline injection initial angle.

The blocks S1 and S2 in the second embodiment are same as the blocks S1 and S2 the first embodiment. In the second embodiment, the block S2 are re-executed at the predefined time intervals for updating the parameters of the gasoline injection initial angle (mainly updating the self-adaptive controlling volume), thus the gasoline is injected based on the updated parameters of the gasoline injection initial angle. During and because of repetitions of the block S2 at the predefined time intervals, the self-adaptive controlling volume decreases to zero for switching off the self-adaptive controlling mode. The predefined time interval is less than the controlling time duration calculated based on the predicted load of the engine, the engine coolant temperature, and the rotating speed.

In the present disclosure, the method of controlling the fuel injection of the engine adaptive provides a self-adaptive control on the gasoline injection initial angle and confirms the parameters of the gasoline injection initial angle for injecting the gasoline. The parameters of the gasoline injection initial angle include the preset basic gasoline injection initial angle and the self-adaptive controlling volume . The step of confirming the self-adaptive controlling volume for controlling the gasoline to be injected includes confirming the first self-adaptive controlling volume related to the predicted load and the current engine coolant temperature and the second self-adaptive controlling volume at the rotating speed of the engine, and setting a sum of the first and the second self-adaptive controlling volumes as the self-adaptive controlling volume. In the present disclosure, the self-adaptive control on the gasoline injection initial angle is provided based on the conditions of the engine, for example adjusting the injection phase under the condition of requiring instantaneous acceleration. Therefore, the instances and amount of injected gasoline merely wetting the wall of the cylinder sleeve is reduced or avoided, thus the smoke is reduced during combustion.

Figure 4:
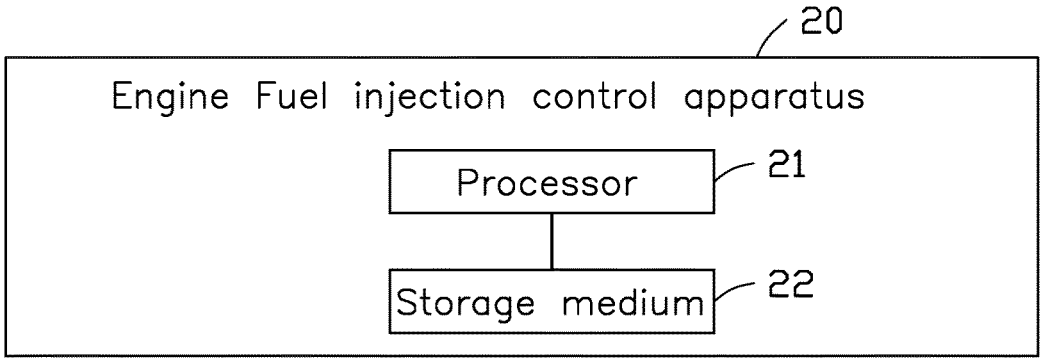
FIG. 4 is a diagram illustrating an embodiment of an engine fuel injection control apparatus according to the present disclosure.

The present disclosure also provides an engine fuel injection control apparatus. FIG. 4 shows the engine fuel injection control apparatus 20. The engine fuel injection control apparatus 20 includes a processor 21 and a storage medium 22. The storage medium 22 stores at least one program instruction, which can be loaded and executed by the processor 21 to implement the method of controlling fuel injection of the engine.

The engine fuel injection control apparatus 20 in the present disclosure applies the self-adaptive control on the gasoline injection initial angle and confirms the parameters of the gasoline injection initial angle for injecting the gasoline. The parameters of the gasoline injection initial angle include the preset basic gasoline injection initial angle and the self-adaptive controlling volume. The step of confirming the self-adaptive controlling volume for controlling the gasoline to be injected includes confirming the first self-adaptive controlling volume related to the predicted load and the current engine coolant temperature and the second self-adaptive controlling volume at the rotating speed of the engine, and setting a sum of the first and the second self-adaptive controlling volumes as the self-adaptive controlling volume. In the present disclosure, the self-adaptive control on the gasoline injection initial angle is applied based on the conditions of the engine, for example adjusting the injection phase under the condition of instantaneous acceleration being required. Therefore, the wetting of the wall of the cylinder sleeve by injected gasoline is reduced or avoided, thus the smoke is reduced while the gasoline is burned.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of controlling fuel injection in an engine fuel injection control apparatus; the engine fuel injection control apparatus comprises a storage medium with program instructions and a processor; the processor executes program instructions in the storage medium to implement the following steps:

providing a self-adaptive control on a gasoline injection initial angle;

confirming parameters of the gasoline injection initial angle, comprising confirming a first self-adaptive controlling volume related to a predicted engine load and a current engine coolant temperature;

confirming a second self-adaptive controlling volume at a rotating speed of the engine; and setting a sum of the first and the second self-adaptive controlling volumes as a self-adaptive controlling volume; and injecting gasoline according to the parameters of the gasoline injection initial angle; the parameters of the gasoline injection initial angle comprise a preset basic gasoline injection initial angle and the self-adaptive controlling volume.

2. The method of claim 1, wherein the step of providing a self-adaptive control on a gasoline injection initial angle comprises:

obtaining a condition of the engine when the engine is activated; and providing a self-adaptive control on a gasoline injection initial angle if the condition of the engine matches with a specified condition.

3. The method of claim 2, wherein the condition of the engine comprises ad time duration of the running engine, a predicted load of the engine, a power-up speed of the engine, an intake air temperature, and a state of the engine; the specified condition comprises the time duration of the running engine being larger than a first specified value, the predicted load of the engine being larger than a second specified value, the power-up speed of the engine being larger than a third specified value, the intake air temperature being larger than a fourth specified value, and the engine in a running state.

4. The method of claim 1, wherein the parameters of the gasoline injection initial angle further comprise a controlling time duration.

5. The method of claim 4, wherein the step of confirming parameters of the gasoline injection initial angle further comprises:

confirming a first controlling time duration based on the predicted load of the engine and the current engine coolant temperature;

confirming a second controlling time duration based on the rotating speed of the engine; and setting a sum of the first and the second controlling time durations as the controlling time duration;

wherein the step of injecting gasoline based on the parameters of the gasoline injection initial angle further comprises:

injecting the gasoline at a gasoline injection angle, which is a sum of the self-adaptive controlling volume and the preset basic gasoline injection initial angle, under a limitation of the controlling time duration.

6. The method of claim 4, wherein the method further comprises:

determining whether a self-adaptive controlling mode of the gasoline injection initial angle is switched on; and modifying the gasoline injection initial angle if the self-adaptive controlling mode is switched off.

7. The method of claim 6, wherein the step of determining whether the self-adaptive controlling mode of the gasoline injection initial angle is switched on comprises:

obtaining the predicted load of the engine or an operation time of the self-adaptive control; and switching off the self-adaptive controlling mode of the gasoline injection initial angle if the predicted load of the engine is less than a preset value or the operation time of the self-adaptive control is larger than or equal to the controlling time duration.

8. The method of claim 6, wherein the self-adaptive controlling volume decreases by a specified gradient value to zero.

9. The method of claim 1, wherein the method further comprises:

updating the parameters of the gasoline injection initial angle at predefined time intervals and injecting gasoline based on the updated parameters of the gasoline injection initial angle.

10. An engine fuel injection control apparatus comprises a non-transitory storage medium with program codes, which when executed by a processor to implement a method; the method comprises:

providing a self-adaptive control on a gasoline injection initial angle; and confirming parameters of the gasoline injection initial angle, comprising:

confirming a first self-adaptive controlling volume related to the load and a current engine coolant temperature;

confirming a second self-adaptive controlling volume at a rotating speed of the engine; and setting a sum of the first and the second self-adaptive controlling volumes as a self-adaptive controlling volume; and injecting gasoline based on the parameters of the gasoline injection initial angle; the parameters of the gasoline injection initial angle comprise a preset basic gasoline injection initial angle and the self-adaptive controlling volume.

11. The engine fuel injection control apparatus of claim 10, wherein the processor further:

obtaining a condition of the engine is obtained when the engine is activated; and providing a self-adaptive control on a gasoline injection initial angle if the condition of the engine matches with a specified condition.

12. The engine fuel injection control apparatus of claim 10, wherein the condition of the engine comprises a time duration of the running engine, a predicted load of the engine, a power-up speed of the engine, an intake air temperature, and a state of the engine; the specified condition comprises the time duration of the running engine being larger than a first specified value, the predicted load of the engine being larger than a second specified value, the power-up speed of the engine being larger than a third specified value, the intake air temperature being larger than a fourth specified value, and the engine in a running state.

13. The engine fuel injection control apparatus of claim 10, wherein the parameters of the gasoline injection initial angle further comprise a controlling time duration.

14. The engine fuel injection control apparatus of claim 13, wherein the processor further:

confirming a first controlling time duration based on the predicted load of the engine and the current engine coolant temperature;

confirming a second controlling time duration based on the rotating speed of the engine; and setting a sum of the first and the second controlling time durations as the controlling time duration;

wherein the step of injecting gasoline based on the parameters of the gasoline injection initial angle further comprises:

injecting the gasoline at a gasoline injection angle, which is a sum of the self-adaptive controlling volume and the preset basic gasoline injection initial angle, under a limitation of the controlling time duration.

15. The engine fuel injection control apparatus of claim 13, wherein the processor further:

determining whether a self-adaptive controlling mode of the gasoline injection initial angle is switched on; and modifying the gasoline injection initial angle if the self-adaptive controlling mode is switched off.

16. The engine fuel injection control apparatus of claim 15, wherein the processor further:

obtaining the predicted load of the engine or an operation time of the self-adaptive control; and switching off the self-adaptive controlling mode of the gasoline injection initial angle if the predicted load of the engine is less than a preset value or the operation time of the self-adaptive control is larger than or equal to the controlling time duration.

17. The engine fuel injection control apparatus of claim 15, wherein the self-adaptive controlling volume decreases by a specified gradient value until zero.

18. The engine fuel injection control apparatus of claim 10, wherein the process further:

updating the parameters of the gasoline injection initial angle at predefined time intervals and injecting the gasoline based on the updated parameters of the gasoline injection initial angle.

* * * * *